US007104415B2

(12) United States Patent
Reutter

(10) Patent No.: US 7,104,415 B2
(45) Date of Patent: Sep. 12, 2006

(54) SEALING CAP

(76) Inventor: Heinrich Reutter, Theodor-Heuss-Strasse 12, 71336, Waiblingen (DE)

( * ) Notice: Subject to any disclaimer, the term of this patent is extended or adjusted under 35 U.S.C. 154(b) by 527 days.

(21) Appl. No.: 10/239,843

(22) PCT Filed: Mar. 21, 2001

(86) PCT No.: PCT/EP01/03232

§ 371 (c)(1),
(2), (4) Date: Jul. 3, 2003

(87) PCT Pub. No.: WO01/75282

PCT Pub. Date: Oct. 11, 2001

(65) Prior Publication Data

US 2004/0056034 A1 Mar. 25, 2004

(30) Foreign Application Priority Data

Mar. 31, 2000 (DE) ..... 100 15 563
Jul. 18, 2000 (DE) ..... 100 34 761

(51) Int. Cl.
*B65D 51/16* (2006.01)

(52) U.S. Cl. ..... 220/303; 220/DIG. 32; 220/203.25; 220/203.12; 220/203.28

(58) Field of Classification Search ..... 220/303, 220/366.1, DIG. 32, DIG. 33, 203.01, 203.02, 220/203.05, 203.11, 203.12, 203.23, 203.24, 220/203.25, 203.26, 203.27, 203.28, 203.29
See application file for complete search history.

(56) References Cited

U.S. PATENT DOCUMENTS 5,174,463 A * 12/1992 Scharrer ..... 220/203.26
5,603,425 A * 2/1997 Breeden ..... 220/203.06
5,850,908 A * 12/1998 Jasek ..... 220/203.23
6,367,644 B1 * 4/2002 Reutter ..... 220/203.26
6,378,717 B1 * 4/2002 Reutter ..... 220/201
6,390,318 B1 * 5/2002 Tanaka et al. ..... 220/203.26
6,481,592 B1 * 11/2002 Harris ..... 220/203.24
6,796,451 B1 * 9/2004 Harris ..... 220/203.26
2003/0185276 A1 * 10/2003 Reutter ..... 374/146
2004/0011788 A1 * 1/2004 Harris ..... 220/203.26
2004/0099668 A1 * 5/2004 Reutter ..... 220/303

FOREIGN PATENT DOCUMENTS

DE 4107525 C1 5/1992
DE 19753592 A1 6/1999

* cited by examiner

*Primary Examiner*—Nathan J. Newhouse
*Assistant Examiner*—James Smalley
(74) *Attorney, Agent, or Firm*—Bacon & Thomas

(57) ABSTRACT

The invention relates to a sealing cap (11), for openings and containers. The valve arrangement (15) comprises an axiallly displaceable valve body (17), which is held in the direction of the container interior by means of a spring (22) against a first sealing seat (34), on the cap interior. The valve arrangement (15) comprises one single valve body (17), provided with a first axially effective sealing surface arrangement (20) and a second radially effective sealing surface arrangement (21). The axially effective sealing surface arrangement (20) co-ordinates with an axial seal seat (34), surrounding a defined opening (32), connecting to the container interior on the cap inner part (14). The radially effective sealing surface arrangement (21) co-ordinates with a first radial counter sealing surface (61, 62), comprising a bypass (39), for the first flow connection and a second radial counter sealing surface (61), comprising a safety relief opening (69), for the second flow connection.

8 Claims, 9 Drawing Sheets

SEALING CAP

FIELD OF THE INVENTION

The present invention relates to a sealing cap for openings of containers, especially of motor-vehicle radiators.

BACKGROUND ART

In one such sealing cap, known from German Patent Disclosure DE 197 53 592 A1, the valve arrangement has two valve bodies, of which, in the position of repose, the first valve body rests directly on a sealing seat of an inner cap part under spring loading, and the second valve body is pressed against a further compression spring by the spring-loaded first valve body. The two-stage opening and closing of the flow connections is achieved by providing that the first valve body is lifted by means of the second valve body from its sealing seat on the inner cap part if the first limit value is exceeded; that when the second limit value is reached, the second valve body presses against a further sealing seat of the inner cap part and thus closes the first flow connection again; and that for the safety stage, an intermediate valve body disposed between the first and second valve bodies lifts with its sealing seat from a sealing face of the second valve body.

In terms of its valve arrangement, a sealing cap of this kind is complicated structurally, in terms of production, and in terms of assembly because of the many components.

From German Patent DE 41 07 525 C1, a sealing cap is also known that provides for a two-stage pressure equalization of the close container that may become necessary. In this sealing cap, the valve arrangement also has two valve bodies, which are internested in one another; the second valve body is pressed against a sealing seat on the inner cap part by the spring loading of the first valve body. In this arrangement, when the first limit value of the internal container pressure is exceeded, the second valve body lifts, carrying the first valve body with it, from its sealing seat on the inner cap part, and when the second limit value is reached presses against an opposed sealing face of the inner cap part again. In the safety stage, the first valve body is lifted from the second valve body.

In the valve arrangement of this known sealing cap, the same disadvantages arise as in the sealing cap described earlier above, and furthermore there is the problem that the sealing seats and sealing faces of the two valve bodies and of the inner cap part, along with the axial travel of the second valve body, must be adapted to one another within narrow tolerances.

From German Patent Disclosure DE 197 32 885 A1, a sealing cap with safety locking for openings of containers is also known. This safety locking makes it possible, when overpressure prevails in the container, to prevent the sealing cap from coming unscrewed, specifically by providing that the sealing cap is blocked nonrotatably relative to the fill nozzle on the container. This known safety locking uses an axially movable insert, which surrounds the inner cap part or its valve arrangement and is as a result exposed directly to the overpressure prevailing in the container, because its inner bottom is located in the opening of the fill nozzle. This axially movable insert is axially movable but is retained nonrotatably in a tubular supplementary inner part which is seated nonrotatably in the fill nozzle of the container and relative to which the sealing cap is rotatable. When overpressure occurs in the container, the insert is moved axially in the direction of the sealing cap and engages it nonrotatably. The result is a blockage of rotation of the sealing cap via the insert and the supplementary inner part with the fill opening of the container.

The provisions in this reference for torsion prevention or safety locking are complicated both structurally and because of the number of components to be used. Moreover, the axially movable insert and the tubular supplementary inner part not only increase the diameter of the inner cap part of the sealing cap but also reduce the effective area of the valve arrangement of the sealing cap, with adverse effects on the response behavior of the valve arrangement.

SUMMARY OF THE INVENTION

It is therefore the object of the present invention to provide a sealing cap of the type defined at the outset whose valve arrangement is simplified structurally and in terms of production and assembly.

For attaining this object in a sealing cap of the type defined above, wherein the valve arrangement has a single valve body which is provided with a first, axially effective sealing face arrangement and a second, radially effective sealing face arrangement. The axially effective sealing face arrangement has an axial sealing seat surrounding a connection opening to the container interior at the inner cap part, and the radially effective sealing face arrangement has a first radical counterpart sealing face, having a bypass around the first flow connection and the second radical counterpart sealing face having a safety relief opening of the second flow connection.

By means of the provisions of the invention, it is attained that considerably fewer components are needed for the valve arrangement of the sealing cap without having to accept disadvantages in terms of the two-stage action upon pressure equalization. Moreover, special provisions for tolerance-bound adaptation become unnecessary. The individual components are structurally simpler and can be produced and put together more economically.

In a preferred exemplary embodiment, the axially effective sealing face arrangement and the radially effective sealing face arrangement of the valve body are united in a profiled sealing ring, so that a single sealing element suffices.

An advantageous feature of the axial sealing seat is characterized in that the axial sealing seat on the inner cap part is formed by an annular attachment which protrudes from the bottom that is provided with the connection opening.

The first radial counterpart sealing face is formed by the inner wall of the inner cap part, in which wall, in a first axial region, an annular insert is received, which forms a bypass around the first flow connection. With these characteristics, an advantageous feature of the first radial counterpart sealing face is attained in such a way that the inner wall of the inner cap part is immediately available for this purpose. By embodying the bypass as a U-shaped throttling conduct on at least one circumferential point of the inner cap part, and by providing two radial conduits in the annular insert disposed in axial spacing, which are formed by an axial conduit between the outer face of the annular insert and the inner face of the inner cap part, it is attained that the closure of the flow connection in the region of the bypass is accomplished primarily by the presence of liquid coolant, rather than by the elevated gas pressure, because whenever liquid coolant is present at the inlet to the bypass, a head pressure builds up that moves the valve body farther in the axial direction, thus preventing an ejection of liquid coolant.

In other words, upon an increase in the internal container pressure, the air cushion located above the liquid coolant can escape in this way and contribute to a pressure equilibrium until such time as it has been reduced and the liquid coolant is present.

An advantageous feature of the radially effective sealing face arrangement lies in the sealing face arrangement having two sealing face regions whose axial spacing is less than the axial spacing of the two radial conduits of the bypass, and/or, the sealing face regions being formed by a circumferential clearance in the profiled sealing ring, or in that the second radial counterpart sealing face is formed by the inner wall of the inner cap part, in which the safety relief openings are formed in a second axial region, or in that the two axial regions of the inner wall of the inner cap part overlap.

Advantageously, the valve body is guided on the inner cap part wherein the valve body has a guide sleeve disposed facing away from the profiled sealing ring, with the guide sleeve cooperating with a guide ring protruding axially from the inner cap part, and/or, a compression spring that acts on the valve body is retained inside the guide ring.

To simplify assembly, the inner cap part is divided in two in that the inner cap part is axially divided in two.

With these characteristics of whereby the valve body has a central opening, through which a negative-pressure valve body protrudes, whose sealing seat surrounds the central opening and rests on a further axial sealing face of the valve body, and the further axial sealing face is part of the axially effective sealing face arrangement or of the profiled sealing ring, and the negative-pressure valve body prestressed against the further axial sealing face of the valve body with the aid of a spring braced on the top side of the valve body, an advantageous disposition of a negative-pressure valve body in the sealing cap is achieved.

To provide a remedy for unscrewing the sealing cap, the outer cap part on which the inner cap part is retained in a suspended fashion, is formed by grip and closure elements that are rotatable relative to one another, and for their releasable connection in a manner fixed against relative rotation, an axially movable coupling insert is provided, whose axial motion is derived from the pressure-dependent axial motion of a sole valve body are provided in a sealing cap of this kind, so that its torsion prevention upon overpressure can be established in a way that is simpler both structurally and in terms of production and is therefore more economical. This is because, as a result of the direct derivation of motion from the sole valve body, no additional components are necessary; instead, idle travel is achieved between the closure element that carries the thread or the like and the grip element or actuating handle upon overpressure. This idle travel connection at overpressure has the substantial advantage, compared with blocking the sealing cap upon overpressure, that the activation of the torsion prevention becomes visually noticeable, thus precluding possible exertions of force in the event of blockage.

Further space is saved for the valve arrangement in that the axially movable coupling insert is disposed inside the grip element of the outer cap part.

A reinforcement of the axial motion of the coupling insert is obtained in that an axial spring coupling for disengagement and/or engagement of the coupling insert is provided between the axially movable coupling insert and the valve body. For guiding the valve body and the coupling insert in the back and forth motion, the axially movable guide element is provided between the axially movable coupling insert and the valve body. It may be expedient to embody the guide element so that it is axially movable inside the hollow coupling insert and is retained in a maximal extension position by end stop elements. The sleeve element can thus actively return the coupling insert from its disengaged position to its engaged position in conjunction with the spring coupling. The guide element and the coupling insert are retained rotatably relative to one another.

Preferred features and dispositions of the compression springs of the spring coupling of the valve body, guide element and inner cap part are also obtained by the provision of having the axial spring coupling surround the guide element, by the axial spring coupling having a first helical compression spring, which is provided between the guide element and the coupling insert, by the axial spring coupling having a second helical compression spring, which is disposed between the guide element and the inner cap part, and by the helical compression spring acting on the sole valve body surrounding the compression spring or compression springs of the axial spring coupling.

In a further feature of the engagement and disengagement connection of the coupling insert, the axially movable coupling insert is constantly connected in a manner fixed against relative rotation to the grip element of the outer cap part and is axially movable relative to them and is connectable releasably to the closure element of the outer cap part by axial engagement and disengagement in the circumferential direction, and the releasable connectability in the circumferential direction is formed by an axially oriented circumferential toothing of the closure element and the coupling insert.

Further details of the invention can be derived from the ensuing description, in which the invention is described and explained in terms of the exemplary embodiments shown in detail in the drawing.

DESCRIPTION OF THE PREFERRED EMBODIMENTS

Figure 1:
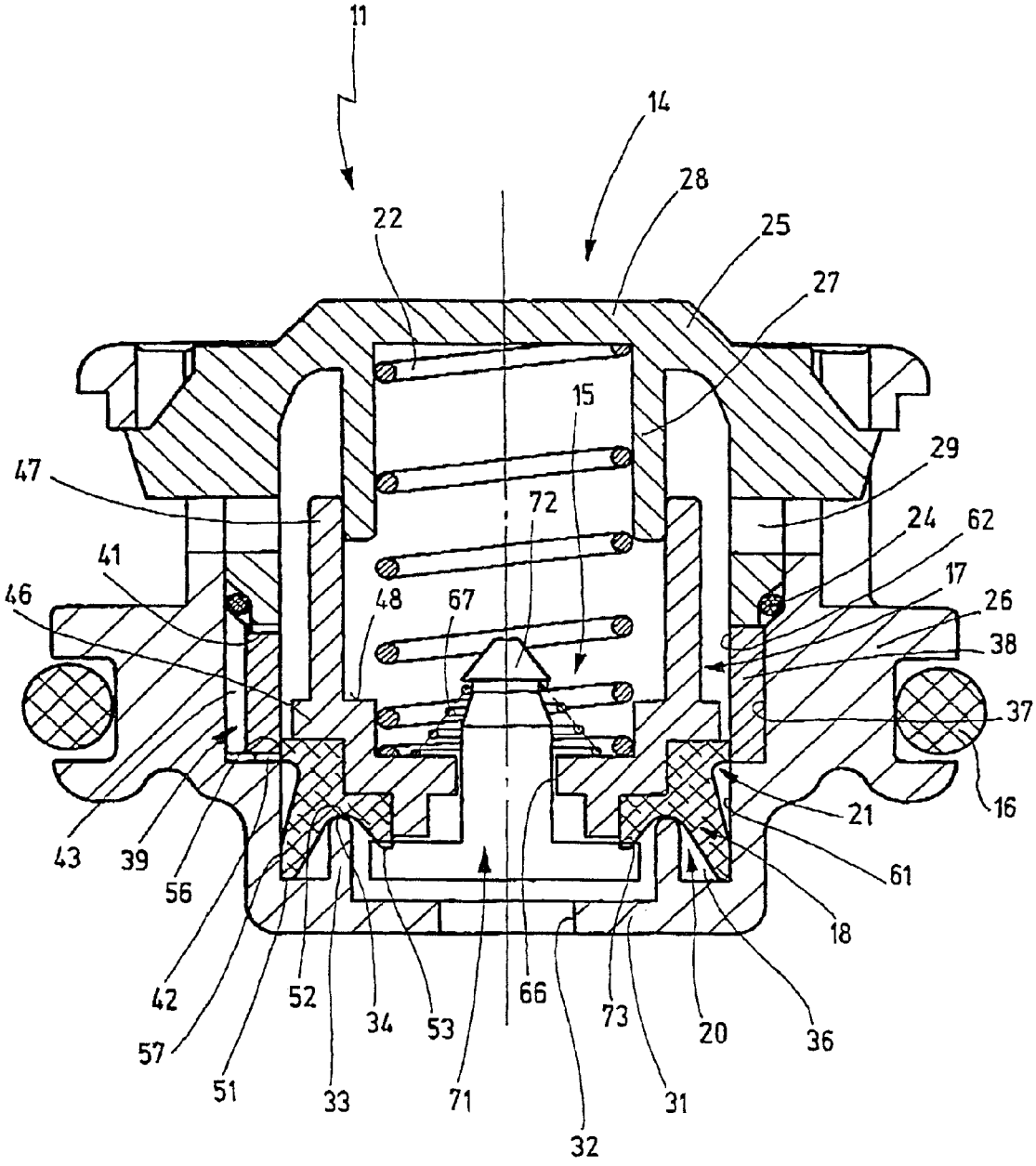
FIG. 1, is a longitudinal sectional view, an overpressure/negative-pressure valve arrangement of a sealing cap for a motor-vehicle radiator, in the closed outset position, in a first exemplary embodiment of the present invention.

The sealing cap 11 shown in FIGS. 1–4, for instance for a motor-vehicle radiator, in a manner not shown has an outer cap part, which is provided with an actuating handle and on which an inner cap part 14 with a negative-pressure/overpressure valve arrangement 15 is retained. In the position for use, the sealing cap 11 is fixed on a radiator neck, not shown, for instance being screwed onto it. The inner cap part 14 protrudes in the radiator neck in the direction of the radiator interior. An O-ring 16 seals the inner cap part 14 off from the radiator neck wall. The overpressure part of the valve arrangement 15 is embodied in two stages and in a first overpressure stage serves to prevent the radiator from boiling dry, while in a second overpressure stage, security against damage to the radiator system from excessive overpressure is assured.

The overpressure part of the valve arrangement 15 has a single valve body 1, which is axially movable between two terminal positions inside the inner cap part 14. The valve body 17 has a profiled ring seal 18, which has both an axially effective sealing face arrangement 20 and a radially effective sealing face arrangement 21. The valve body 17 is axially prestressed inward in the direction of the container interior by means of a compression spring 22 braced on the inner cap part 14.

The inner cap part 14 is embodied in two parts and is thus composed of an inner, upper element 25 and an outer main element 26, which is retained in the outer cap part in a manner not shown and in which the inner, upper element 25 is fixed in sealed fashion. The inner, upper element 25 has a coaxial guide ring attachment 27, which protrudes inward from the top 28 of the element 25. This guide ring attachment 27 receives one end of the compression spring 22, which is braced on the inside of the top 28. On the outer circumference, the guide ring attachment 27 serves to provide axial guidance of the valve body 17. At the level of the guide ring attachment 27, the inner cap part 14 is provided with radial outflow openings 29 on the outer circumference. Between the inner, upper element 25 and the main element 26, an O-ring 24 is provided for the sake of tight connection.

The main element 26 of the inner cap part 14, on its bottom 31, has a flowthrough opening 32, in this case coaxial, which forms a communication between the container interior and the interior of the inner cap part 14. The flowthrough opening 32 is surrounded coaxially by an annular attachment 33 that protrudes toward the inside of the inner cap part 14, and its free annular face end forms a sealing seat 34 for the axially effective sealing face arrangement 20 of the profile ring seal 18 of the valve body 17. Between the outer circumference of the annular attachment 33 and the inner circumference of the main element 26, an annular chamber 36 remains in this region. Above this annular chamber 36, the main element 26 of the inner cap part 14 has an annular groove 37, which is open axially outward and in which an annular insert 38 is received that contains or forms a U-shaped throttling conduit 39. In the exemplary embodiment shown, the U-shaped throttling conduit 39 is provided at a point on the circumference of the main element 26 of the inner cap part 14. The throttling conduit 39 has two radial conduit parts 41 and 42, axially spaced apart from one another, which are joined together by an axial conduit part 43 that is located between the applicable inner circumference region of the main element 26 and the applicable outer circumference region of the annular insert 38. The conduit parts 41 and 42 are formed here by radial grooves cut into the annular insert 38, while the conduit part 43 is formed by an axial groove cut into the main element 26.

The one-piece valve body 17 has a main part 46, which is radially stepped in the axial direction and which carries the profile ring seal 18, and a guide part 47, remote from the profile ring seal 18, which is hollow-cylindrical and is guided on the guide ring attachment 47, which it grips, of the inner cap part 14. The compression spring 22 is braced on an inner shoulder, remote from the profile ring seal 18, of the valve body 17.

The profile ring seal 18 is secured to a stepped outer circumferential region of the valve body 17. The axially effective sealing face arrangement 20 of the profile ring seal 18 is arched, viewed in cross section, and has a radially outer sealing face 51, a radially middle sealing face 52, and a radially inner sealing face 53. The radially inner sealing face 53 cooperates with a negative-pressure valve body 71 to be described hereinafter; the radially middle sealing face 52, in the position of repose of the valve arrangement 15, rests on the sealing seat 34 of the inner cap part 14; and the radially outer sealing face 51 rests on the bottom of the annular chamber 36. By comparison, the radially effective sealing face arrangement 21 has two sealing faces 56 and 57 which are disposed at a defined axial spacing and between which a clearance 58 is provided. Both the upper sealing face 56 and the lower sealing face 57, which merges with the radially outer sealing face 51, rest sealingly on the inner wall 61 and/or 62, embodied as a sealing seat, of the main element 26 of the inner cap part 14 and of the annular insert 38, respectively.

In the center of the valve body 17, an opening 66 is provided, which is closed on the side toward the radiator interior by the negative-pressure valve body 71 of the valve arrangement 15. The negative-pressure valve body 71 protrudes with its main part 72 through the central opening 66 and is acted upon in the end region thereof by a compression spring 67, which is braced on one end on a shoulder of the main part 72 and on the other on the outer face of the inner shoulder of the valve body 17, on which the compression spring 22 also rests. In this way, the negative-pressure valve body 71 is pressed sealingly with its annular sealing seat 73 against the radially inner sealing face 53 of the axially effective sealing face arrangement 20 of the profile ring seal 18 of the valve body 17.

In the position of repose, or outset operating position, shown in FIG. 1, in which a first limit value of the internal container pressure has not yet been exceeded, any flow connection between the container interior and container exterior is closed as a result of the sealing contact of all the sealing faces 51–53 of the axially effective sealing face arrangement 20 of the profile seal 18 of the valve body 17 against the respective sealing seats 36, 34, 73 of the inner cap part 14 and of the negative-pressure valve body 71, respectively. In other words, through the flowthrough opening 32, the pressure prevailing in the interior of the container is present in the form of the air cushion, located above the liquid radiator medium, at both the profile ring seal 18 of the valve body 17 and the underside of the negative-pressure valve body 71.

Figure 2:
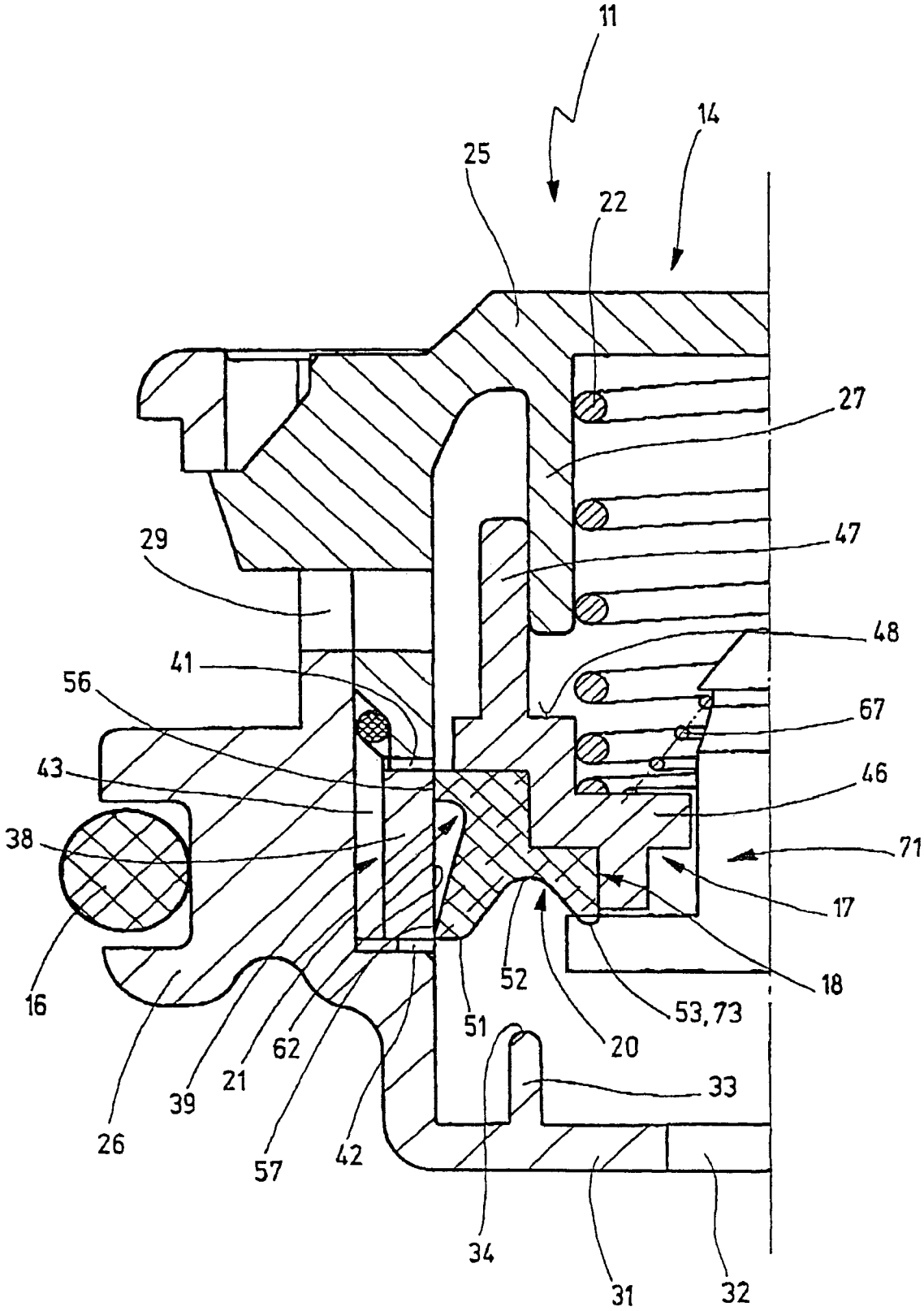
FIG. 2, is a somewhat enlarged half section, the sealing cap of FIG. 1 in a position after a first limit value of the internal container pressure is exceeded.

If the internal container pressure increases above the predetermined first limit value, then the valve arrangement 15 of the sealing cap 11 reaches the operating state shown in FIG. 2, in which the valve body 17, counter to the action of its compression spring 22, lifts with its radially middle sealing face 52 from the sealing seat 34, and the profile ring seal 18 reaches the region of the annular insert 38, in such a way that the two radial sealing faces 56 and 57 of the radially effective sealing face arrangement 21 of the profile ring seal 18 of the valve body 17 are located above and below the radial conduit parts 41 and 42, respectively, and thus open the throttling conduit 39 on both ends. In this operating state, an equilibrium has been established between the action of the internal container pressure and the contrary action of the compression spring 22. Thus a first flow connection between the container interior and the container exterior is opened, leading from the flowthrough opening 32 via the U-shaped throttling conduit 39 to the outflow openings 29. As a result, air from the air cushion located above the liquid radiator medium can flow to the outside and compensate for or reduce the overpressure. If as a result the overpressure is reduced to below the first limit value, then the valve body 17 returns to sealing contact with the axial sealing seat 34 of the inner cap part 14.

Conversely, if the internal container pressure increases further even during or after the elimination of the air cushion, and if this causes liquid radiator medium to reach the underside of the profile ring seal 18 and of the negative-pressure valve body 71, then the result, because of the very narrow throttling conduit 39 (with a cross-sectional size on the order of a few hundredths of a millimeter) is a backup of the liquid radiator medium at the entrance to the lower radial conduit part 42 of the throttling conduit 39, and thus a head pressure at the full-surface undersides of the profile ring seal 18 and negative-pressure valve body 71. This head pressure causes an axial motion of the valve body 17 onward, counter to the action of the compression spring 22, so that in the operating state of FIG. 3, the throttling conduit 39 is closed again at the upper radial conduit part 41. In this operating state, the throttling conduit 39 is thus closed in such a way that its upper radial conduit part 41 opens into the clearance space 58 between the two sealing faces 56 and 57 of the profile ring seal 18. An ejection of liquid radiator medium is thus prevented. If the internal container pressure is reduced by cooling down of the motor-vehicle radiator, and the liquid radiator medium is thus returned, then the valve body 17 can also be restored under the action of its compression spring 22, so that the throttling conduit 39 opens again, and a further pressure buildup can take place.

Conversely, if the internal container pressure continues to increase, then when an upper (safety) pressure limit value is exceeded, the valve body 17 is lifted farther, counter to the compression spring 22 loading it, so that windows 69 located at certain circumferential regions in the wall of the inner cap part 14, which communicate with the container interior (FIG. 4) in a manner not shown, are opened. In this state, as before, the upper conduit part 41 opens into the clearance space 58, which has no communication with the outflow openings 29. This upper terminal position of the valve body 17 is defined by the contact of an inner step 48 of the valve body 17 with the free annular face end of the guide ring attachment 27 of the inner cap part 14. As a result, the aforementioned overpressure can be reduced via a second flow connection, after which a corresponding restoration of the valve body 17 over the various operating states can occur.

Figure 3:
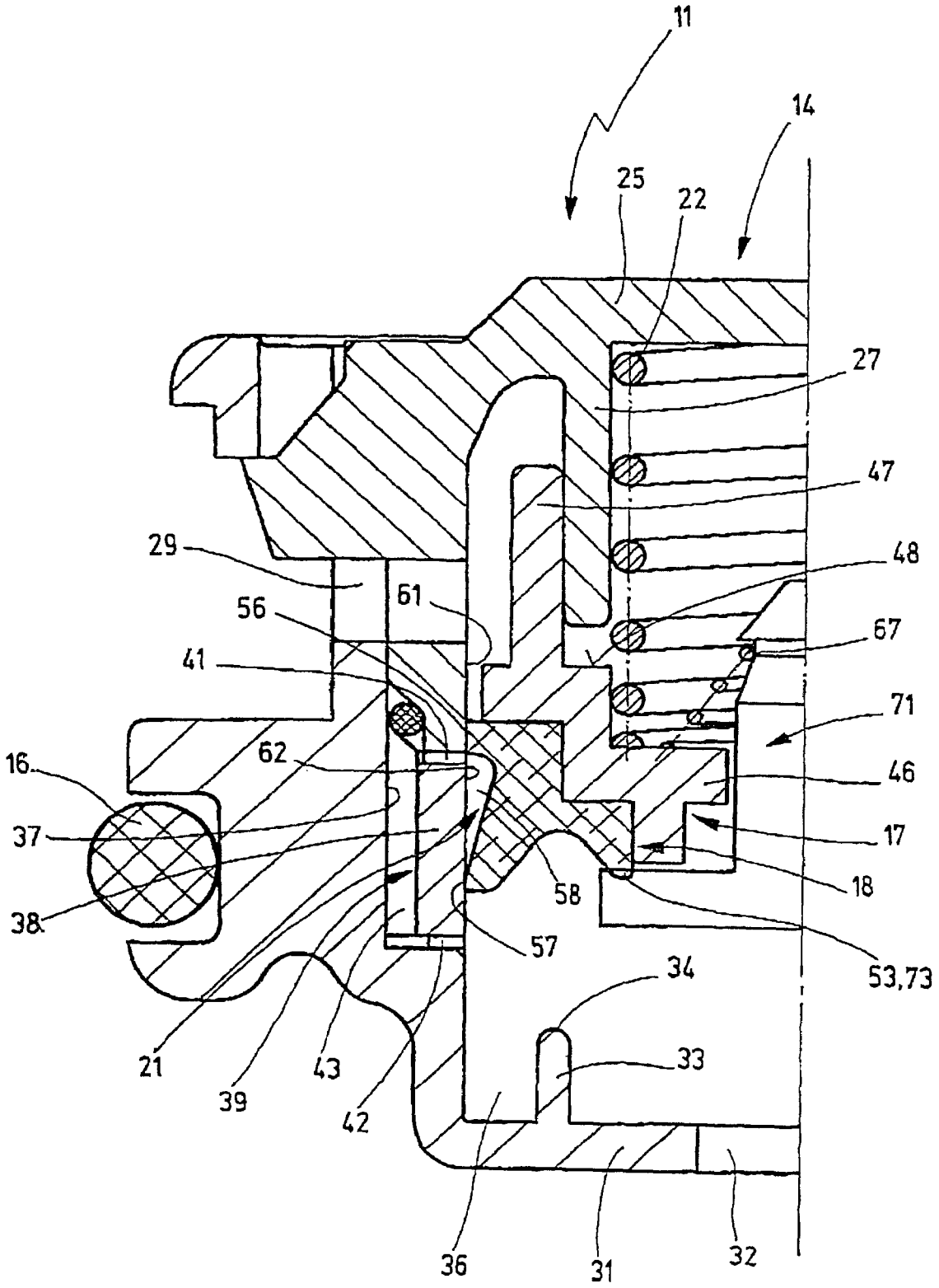
FIG. 3, is a view corresponding to FIG. 2, but in a position after a second limit value of the internal container pressure is reached, or a fluid head pressure is applied.
Figure 4:
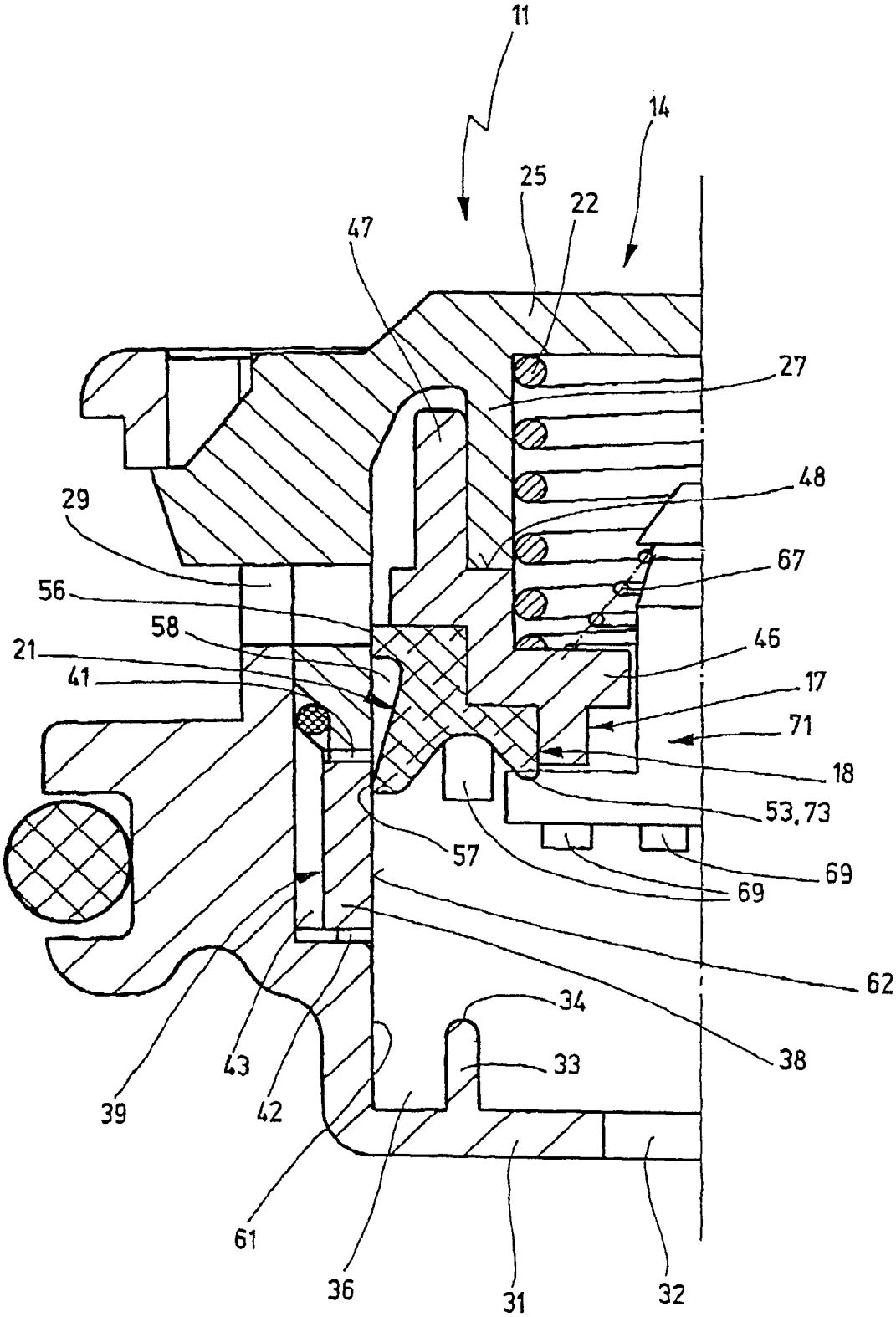
FIG. 4, is a view corresponding to FIG. 2, but in a position after a third or safety limit value of the internal container pressure is exceeded.

The outset position shown in FIG. 1 is assumed by the valve arrangement 15 whenever the internal pressure in the radiator is moving between a negative-pressure limit value and the first overpressure limit value. Such pressure conditions exist for instance in a vehicle that has been parked for a relatively long time, or during vehicle travel when there is adequate cooling of the coolant in the radiator interior by the relative wind and/or by a fan. If after a relatively long trip the vehicle is stopped after a relatively long trip, there can be a resultant pressure increase in the radiator interior, allowing the contents of the radiator (air or water or water vapor) to flow to the valve arrangement 15. If the coolant volume expands from this after-heating effect to such an extent that the container volume is exceeded, this would necessarily cause the expulsion of coolant. This unwanted effect is prevented, in the manner described above, because the operating state of the valve arrangement 15 as shown in FIG. 3 is established. If in this operating state a further uncontrolled pressure rise in the cooling system occurs, then leaks and other adverse effects resulting from an overload on the radiator container and/or the hose connection points must be averted. These effects are averted by the second valve stage, in the state shown in FIG. 4, which limits the container pressure to a predetermined safety pressure value.

If negative pressure prevails in the radiator interior, and this pressure falls below a predetermined negative-pressure limit value, then beginning at the operating state shown in FIG. 1, the negative-pressure valve body 71 with its sealing seat 73 is lifted from the radially inner sealing face 53 of the profile ring seal 18 of the valve body 17 toward the radiator interior. The lowering of the negative-pressure valve body 71 takes place counter to the prestressing force of the compression spring 67, so that in a manner not shown, a third flow connection between the radiator interior and the radiator exterior opens.

The sealing cap 111, for instance for a motor-vehicle radiator, shown in FIGS. 5–9 has an outer cap part 110, which is provided with a grip element or actuating handle 112, and on whose closure element 113, embodied here as a screw-on element, an inner cap part 114 is kept suspended and retained relatively rotatably with a negative-pressure/overpressure valve arrangement 115. In the position for use, the sealing cap 111 is fixed, for instance being screwed on, to a radiator neck, not shown. The inner cap part 114 protrudes within the radiator neck in the direction of the radiator interior. An O-ring 116 seals off the inner cap part 114 from the radiator neck wall. In the two-part outer cap part 110, the caplike actuating handle 112 is axially fixed on the screw-on element 113 but is rotatable in the circumferential direction. This rotatability is blocked, at normal pressure in the radiator interior, by an axially movable coupling insert 180 for screwing and unscrewing the sealing cap 111.

The overpressure part of the valve arrangement 15 is embodied in two stages and in a first overpressure stage serves to prevent the radiator from boiling dry, while in a second overpressure stage, security against damage to the radiator system from excessive overpressure is assured.

The overpressure part of the valve arrangement 115 has a single valve body 117, which is axially movable between two terminal positions inside the inner cap part 114. The valve body 117 has a profiled ring seal 118, which has both an axially effective sealing face arrangement 120 and a radially effective sealing face arrangement 121. The valve body 117 is axially prestressed inward in the direction of the container interior by means of a compression spring 122 braced on the inner cap part 114.

The inner cap part 114 is embodied in two parts and thus is composed of an inner element 125 and an outer, main element 126, which is kept suspended in the screw-on element 113 of the outer cap part 110 and in which the inner element 125 is fixed in sealed fashion. The inner element 125 is approximately hood-shaped, with an axial opening in the hood bottom 128, on whose inside one end of the compression spring 122 is braced. Approximately at the level of the lower end of the outer cap part 110, the inner cap part 114 is provided on its outer circumference with radial outflow openings 129. Between the inner element 125 and the main element 126, an O-ring 124 is provided for the sake of tight connection.

The main element 126 of the inner cap part 114, on its bottom 131, has a flowthrough opening 132, in this case coaxial, which forms a communication between the container interior and the interior of the inner cap part 114. The flowthrough opening 132 is surrounded coaxially by an annular attachment 133 that protrudes toward the inside of the inner cap part 114, and its free annular face end forms a sealing seat 134 for the axially effective sealing face arrangement 120 of the profile ring seal 118 of the valve body 117. Between the outer circumference of the annular attachment 133 and the inner circumference of the main element 126, an annular chamber 136 remains in this region. Above this annular chamber 136, between the lower annular face end of the inner element 125 and a setback in the main element 126 of the inner cap part 114, an annular insert 138 is received that contains or forms a U-shaped throttling conduit 139. In the exemplary embodiment shown, the U-shaped throttling conduit 139 is provided at a point on the circumference of the inner cap part 114. The throttling conduit 139 has two axially spaced-apart radial conduit parts 141 (adjacent to the inner element 125) and 142 (adjacent to the setback in the main element 126), which are joined together by an axial conduit part 143 that is located between the applicable inner circumference region of the main element 126 and the applicable outer circumference region of the annular insert 138. The conduit parts 141, 142 and 143 are formed here by radial and axial grooves cut into the annular insert 138.

The one-piece valve body 117 has a main part 146, which is radially stepped in the axial direction and which carries the profile ring seal 118, and on which, remote from the profile ring seal 118, a guide element 147 is seated, which is hollow-cylindrical and engages the hollow coupling insert 180. The compression spring 122 is braced on a radial outer shoulder of the main part 146 of the valve body 117.

The profile ring seal 118 is secured to the inside face of a stepped outer circumferential region of the valve body 117. The axially effective sealing face arrangement 120 of the profile ring seal 118 is arched, viewed in cross section, and has a radially outer sealing face 151, a radially middle sealing face 152, and a radially inner sealing face 153. The radially inner sealing face 153 cooperates with a negative-pressure valve body 171 to be described hereinafter; the radially middle sealing face 152, in the position of repose of the valve arrangement 115, rests on the sealing seat 134 of the inner cap part 114; and the radially outer sealing face 151 rests on the bottom of the annular chamber 136. By comparison, the radially effective sealing face arrangement 121 has two sealing faces 156 and 157 which are disposed at a defined axial spacing and between which a clearance 158 is provided. Both the upper sealing face 156 and the lower sealing face 157, which merges with the radially outer sealing face 151, rest sealingly on the inner wall 161 and/or 162, embodied as a sealing seat, of the main element 126 of the inner cap part 114 and of the annular insert 138, respectively.

Figure 5:
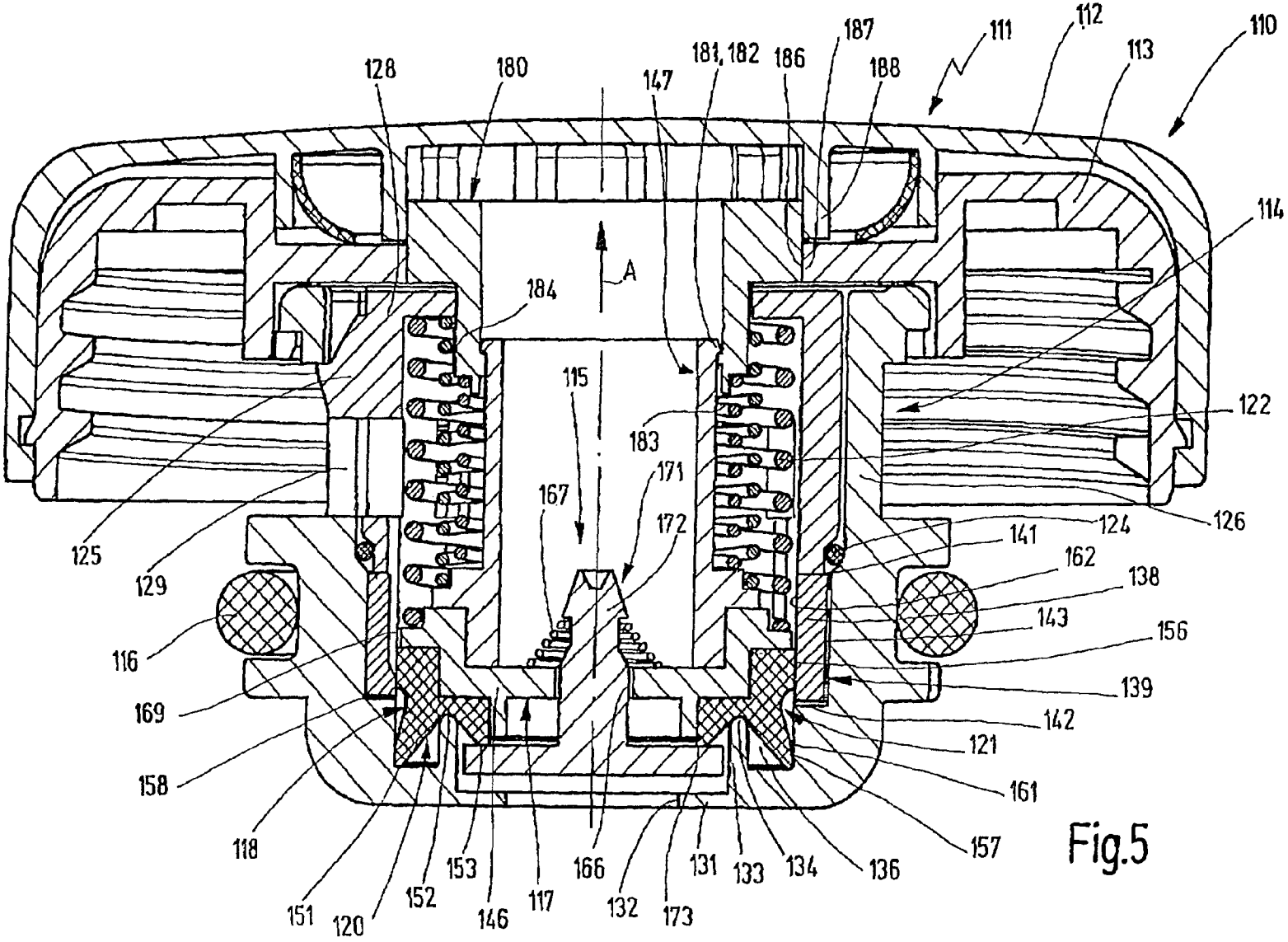
FIG. 5, is a longitudinal sectional view of a sealing cap for a motor-vehicle radiator with an overpressure/negative-pressure valve arrangement and torsion prevention in the closed or nonactivated outset position, in a second exemplary embodiment of the present invention.

The guide element 147, seated with an inner end on the outer face of the inner shoulder of the valve body 117, protrudes with its other end into the central through opening of the coupling insert 180. The coupling insert 180 and guide element 147 are rotatable relative to one another and displaceable axially to one another. The axial displaceability is limited, as FIG. 5 shows, by shoulders 181, 182 resting on one another, in such a way that the guide element 147 and coupling insert 180 always engage one another. The guide element 147 is embodied in sleevelike fashion, and its outer wall is stepped on the inner end, toward the valve body 147, to form contact shoulders for an axial spring coupling arrangement. The spring coupling arrangement has a first, inner helical compression spring 183, which is prestressed between the coupling insert 180 and the guide element 147, and a second, by comparison outer, helical compression spring 184, which is braced on one end on the guide element 147 and on the other in the inner element 125 of the inner cap part 114. These two helical compression springs 183 and 184 are surrounded by the helical compression spring 122 that acts on the valve body 117.

The axially displaceable coupling insert 180, which with its lower end that fits over the guide element 147 penetrates a central through bore in the inner element 125 of the inner cap part 114, rests with its outer end, of larger outer diameter, in the outset state shown in FIG. 5, inside a recess 186 of a radial flange 187 of the screw-on element 113 and inside a central annular flange 188 protruding axially inward on the actuating handle 112. With the axial flange 188, the coupling insert 180 is connected constantly nonrotatably to the actuating handle 112, for instance by means of suitable sets of intermeshing teeth. In the outset position shown in FIG. 5, the coupling insert 180 is also nonrotatably connected to the radial flange 187 of the screw-on element 113, specifically once again via circumferential, axially extending toothing arrangements, not shown. In this way, the actuating handle 112 and the screw-on element 113 are nonrotatably joined together in the circumferential direction, so that the sealing cap 111 can be screwed onto the fill neck, not shown, of a container and unscrewed from it by means of the actuating handle 112.

In the center of the valve body 117, an opening 166 is provided, which on the side toward the radiator interior is closed by the negative-pressure valve body 171 of the valve arrangement 115. The negative-pressure valve body 171 protrudes with its main part 172 through the central opening 166 and is acted upon on its end region by a compression spring 167, which is braced on one end on a shoulder of the main part 172 and on the other on the outer face of the inner shoulder of the valve body 117. In this way, the negative-pressure valve body 171 is pressed sealingly with its annular sealing seat 173 against the radially inner sealing face 153 of the axially effective sealing face arrangement 120 of the profile ring seal 118 of the valve body 117.

In the position of repose or outset operating position shown in FIG. 5, in which as yet no overpressure prevails in the container interior, any flow connection between the container interior and container exterior is closed as a result of the sealing contact of all the sealing faces 151–153 of the axially effective sealing face arrangement 120 of the profile seal 118 of the valve body 117 against the respective sealing seats 136, 134, 173 of the inner cap part 114 and of the negative-pressure valve body 171, respectively. In other words, through the flowthrough opening 132, the pressure prevailing in the interior of the container is present in the form of the air cushion, located above the liquid radiator medium, at both the profile ring seal 118 of the valve body 117 and the underside of the negative-pressure valve body 171.

Figure 6:
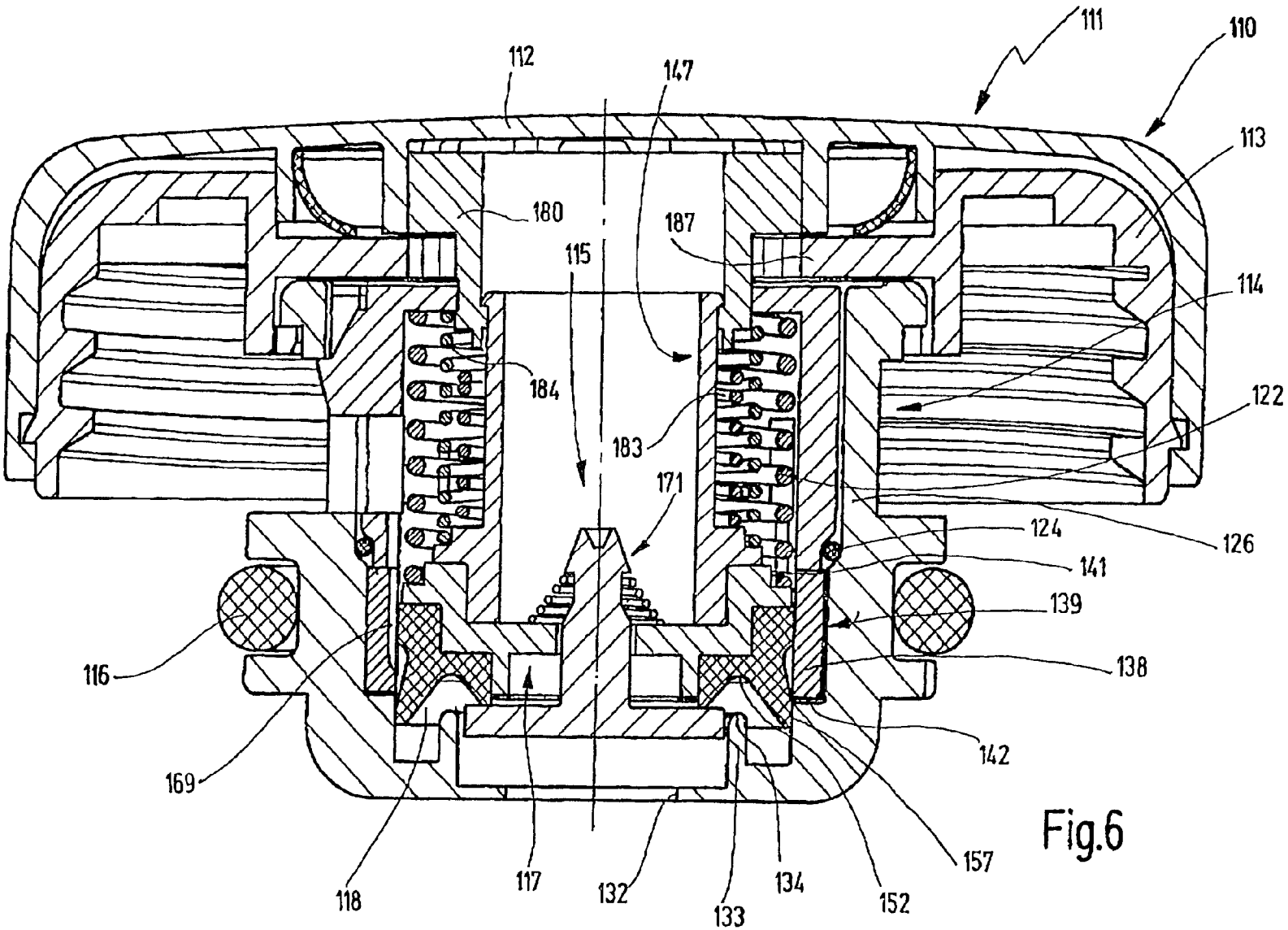
FIG. 6, is a view corresponding to FIG. 5, but in a position during the buildup of an overpressure in the container interior.

If the internal container pressure increases to a certain amount, which is above the normal pressure but below a first limit value of the internal container pressure, then the unscrewing prevention of the sealing cap 111 is activated. As shown in FIG. 6, the valve body 117 is moved upward, so that the profile ring seal 118 lifts with its middle sealing face 152 from the sealing seat 134. This enlarges the effective area acted upon by the overpressure, an area that until now was formed only by the underside of the negative-pressure valve body 171, around the inner axial face of the profile ring seal 118. This larger effective area, for the same pressure, exerts a greater force on the valve body 117 and results in a lengthened stroke thereof. As a result of the reciprocating motion of the valve body 117, which however does not yet open the throttling conduit 139, counter to the action of the first helical compression spring 183 and the second helical compression spring 184, the guide element 147 is initially axially displaced relative to the coupling insert 180. Since as a result of this reciprocating motion the first helical compression spring 183, which is braced on the coupling insert 180, is prestressed, the coupling insert 180 is axially displaced. As a result of this axial motion outward of the coupling insert 180 in the direction of the arrow A and up to an inner stop at the underside of the actuating handle 112, the coupling insert 180, on its larger-diameter end, comes free of the toothing on the screw-on element 113. This disengagement motion of the coupling insert 180 causes the actuating handle 112 to revolve idly relative to the screw-on element 113, so that beyond a certain defined overpressure (in this case, 0.3 bar, for instance), unscrewing of the sealing cap 111 is no longer possible.

Figure 7:
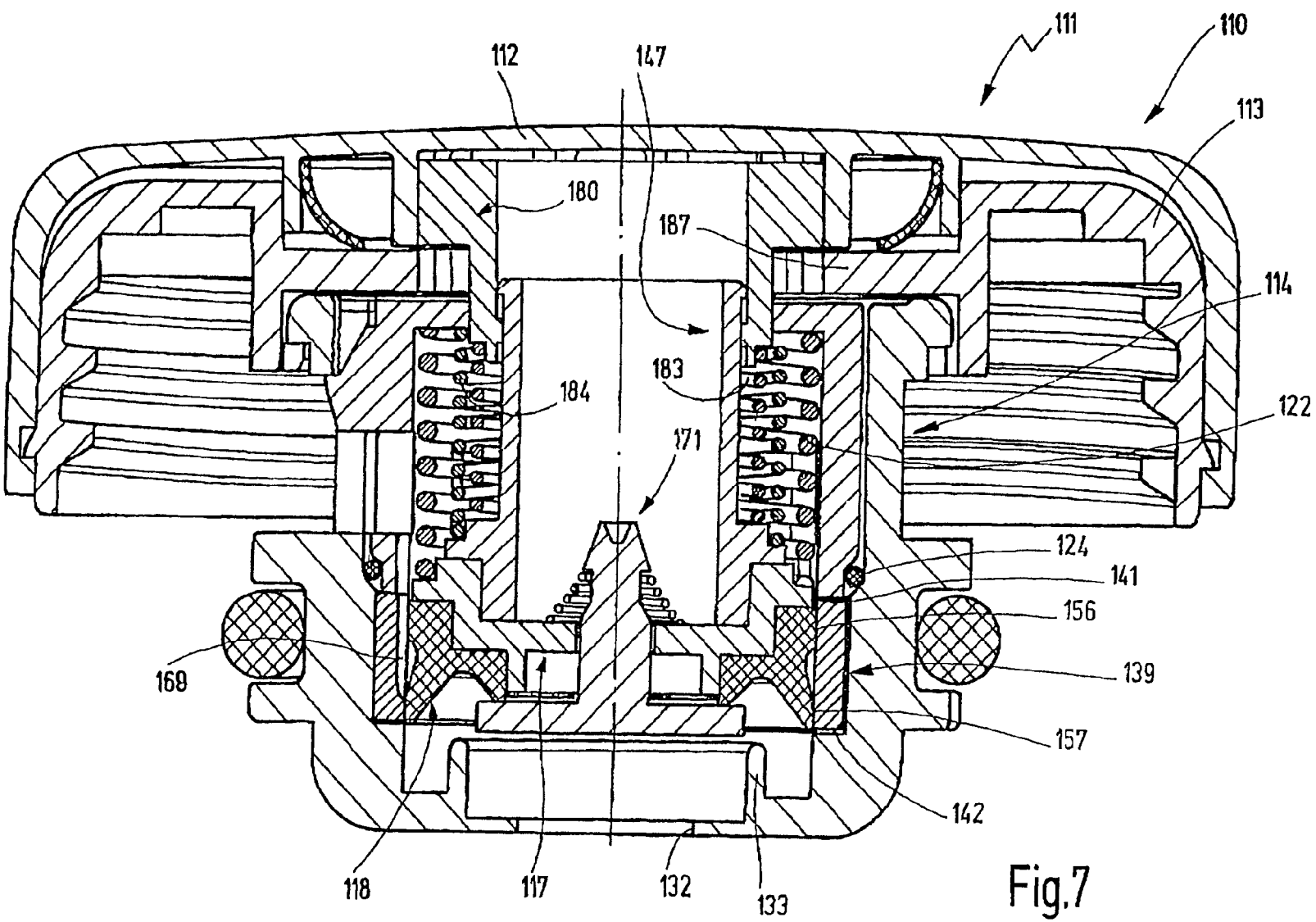
FIG. 7, is a view corresponding to FIG. 5, in a position after a first limit value is exceeded but before a second limit value of the internal container pressure is reached.

If the internal container pressure increases further, that is, beyond the predetermined first limit value (for instance of 1.4 bar), then the valve arrangement 115 of the sealing cap 111 reaches the operating state shown in FIG. 7, in which the valve body 117 lifts away farther, counter to the action of its compression spring 122, and the profile ring seal 118 reaches the region of the annular insert 138 in such a way that the two radial sealing faces 156 and 157 of the radially effective sealing face arrangement 121 of the profile ring seal 118 of the valve body 117 are located above and below the radial conduit parts 141 and 142, respectively, and thus open the throttling conduit 139 on both ends. In this operating state, in which the unscrewing prevention continues to remain activated, an equilibrium has been established between the action of the internal container pressure and the contrary action of the compression spring 122. Thus a first flow connection between the container interior and the container exterior is opened, leading from the flowthrough opening 132 via the U-shaped throttling conduit 139 to the outflow openings 129. As a result, air from the air cushion located above the liquid radiator medium can flow to the outside and compensate for or reduce the overpressure. If as a result the overpressure is reduced to below the first limit value, then the valve body 117 resumes its sealing contact with the axial sealing seat 134 of the inner cap part 114.

Conversely, if the internal container pressure increases further even during or after the elimination of the air cushion, and if this causes liquid radiator medium to reach the underside of the profile ring seal 118 and of the negative-pressure valve body 171, then the result, because of the very narrow throttling conduit 139 (with a cross-sectional size on the order of a few hundredths of a millimeter) is a backup of the liquid radiator medium at the entrance to the lower radial conduit part 142 of the throttling conduit 139, and thus a head pressure at the full-surface undersides of the profile ring seal 118 and negative-pressure valve body 171. This head pressure causes an axial motion of the valve body 117 onward, counter to the action of the compression spring 122, so that in this operating state for instance with a pressure of 1.5 bar, at the upper radial conduit part 141, the throttling conduit 139 is closed again in a manner not shown by the upper radial sealing face 156 of the profile ring seal 118. The unscrewing prevention continues to be activated. An ejection of liquid radiator medium is thus prevented. If the internal container pressure is reduced by cooling down of the motor-vehicle radiator, and the liquid radiator medium is thus returned, then the valve body 117 can also be restored under the action of its compression spring 122, so that the throttling conduit 139 opens again, and a further pressure buildup can take place.

Figure 8:
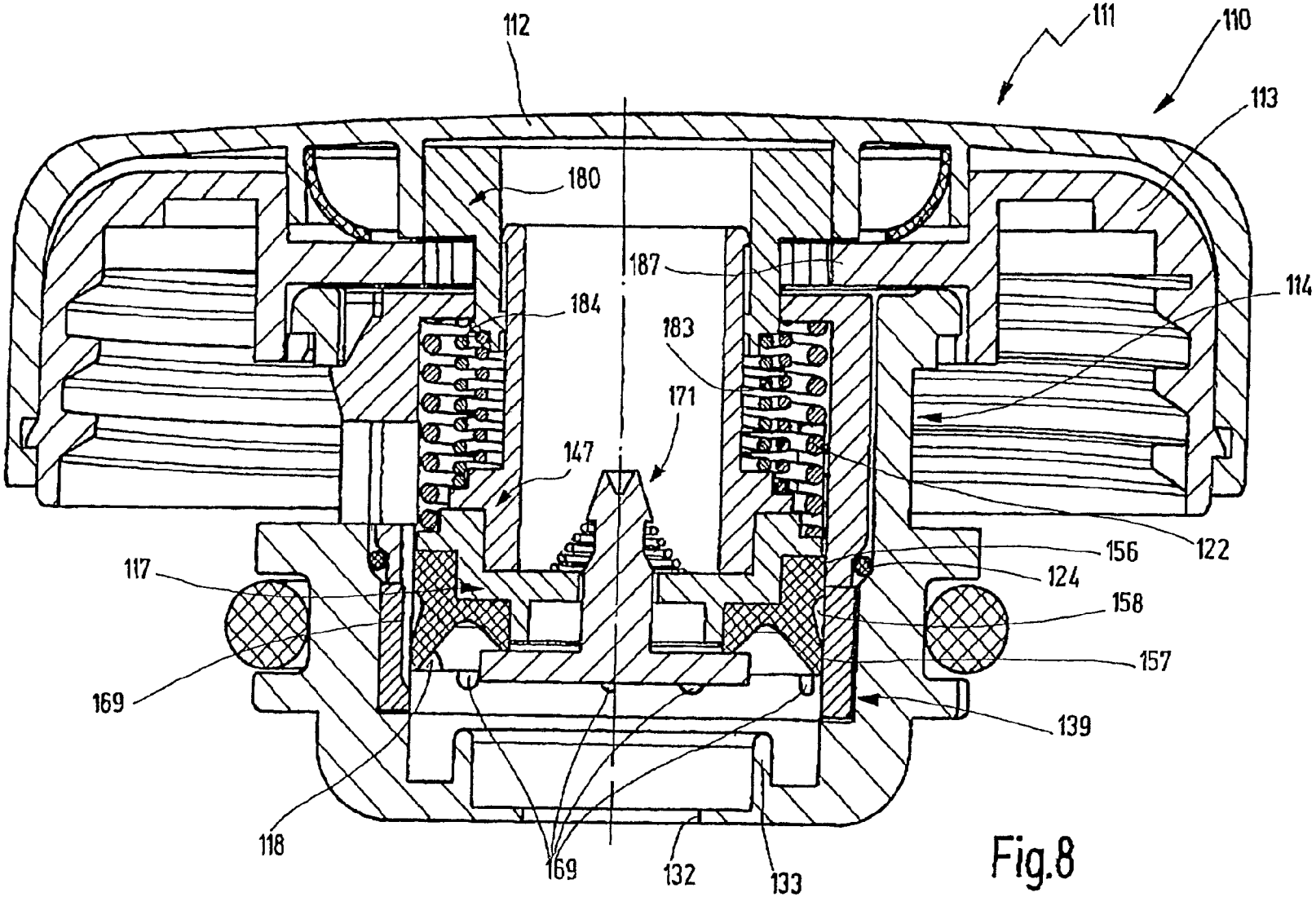
FIG. 8, is a position corresponding to FIG. 5, but in a position after a third or safety limit value of the internal container pressure is exceeded.

Conversely, if the internal container pressure continues to increase, then when an upper (safety) pressure limit value (for instance of 2 bar) is exceeded, the valve body 117 is lifted farther, counter to the compression spring 122 loading it, so that axial outflow conduits 169, located at certain circumferential regions in the wall of both the annular insert 138 and the inner element 125 of the inner cap part 114, are opened, which are in communication with the outflow opening 129 and therefore with the container exterior (FIG. 8). In this operating state, as before, the upper conduit part 141 is still closed. This upper terminal position of the valve body 117 is defined by the compressed compression springs 122, 183, and 184. The unscrewing prevention continues to remain activated. As a result, the aforementioned overpressure can be reduced via a second flow connection, after which a corresponding restoration of the valve body 117 over the various operating states can occur by means of the compression spring 122, as is shown in FIG. 9.

Figure 9:
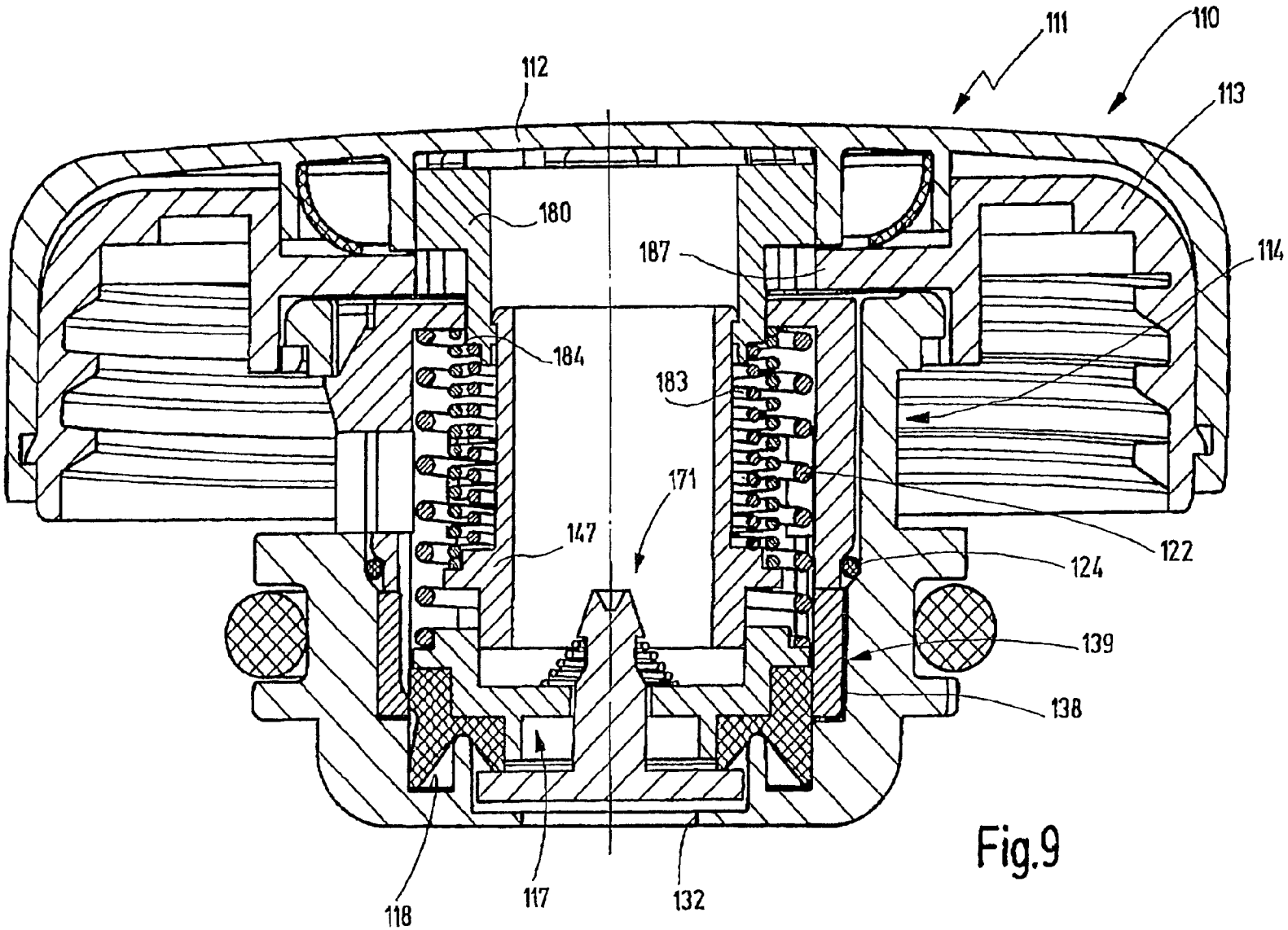
FIG. 9, is a view corresponding to FIG. 5, but in a position after the normal pressure is reached in the container interior and before the torsion prevention is reversed or undone.

FIG. 9 also shows one possible brief state of the unscrewing prevention, whenever the valve body 117 has returned to its outset position and rotation of the actuating handle 112 has occurred while the unscrewing prevention was activated. In that case, it might have happened that the coupling insert 180 with its toothing failed to come precisely above the tooth gaps in the toothing of the unscrewing element 113. In order in this case to return the unscrewing prevention from its activated state to its deactivated state in accordance with FIG. 5, a brief rotary actuation of the actuating handle 112 suffices; this causes the outer, second helical compression spring 184, which is under considerable prestressing, to move the guide element 147 downward, counter to arrow A. This relaxes the inner, first compression spring 183, and the guide element 147, with its outer annular shoulder 181, as a result of contact with the inner annular shoulder 182 of the coupling insert 180, carries this coupling insert along with it in the direction of arrow A, so that the coupling connection between the actuating handle 112 and the unscrewing element 113 is reengaged or comes into effect again. The overall operating position of FIG. 5 is thus achieved, and the sealing cap 111 can be unscrewed from the fill neck of the radiator without danger.

The outset position shown in FIG. 5 is assumed by the valve arrangement 115 whenever the internal pressure in the radiator is moving between a negative-pressure limit value and an only very slight overpressure value, in this case of less than 0.3 bar. Such pressure conditions exist for instance in a vehicle that has been parked for a relatively long time, or during vehicle travel when there is adequate cooling of the coolant in the radiator interior by the relative wind and/or by a fan. If after a relatively long trip the vehicle is stopped after a relatively long trip, there can be a resultant pressure increase in the radiator interior, allowing the contents of the radiator (air or water or water vapor) to flow to the valve arrangement 115. If the coolant volume expands from this after-heating effect to such an extent that the container volume is exceeded, this would necessarily cause the expulsion of coolant. This unwanted effect is prevented. If in this operating state a further uncontrolled pressure rise in the cooling system occurs, then leaks and other adverse effects resulting from an overload on the radiator container and/or the hose connection points must be averted. These effects are averted by the second valve stage, in the state shown in FIG. 8, which limits the container pressure to a predetermined safety pressure value.

If negative pressure prevails in the radiator interior, and this pressure falls below a predetermined negative-pressure limit value, then beginning at the operating state shown in FIG. 5, the negative-pressure valve body 171 with its sealing seat 173 is lifted from the radially inner sealing face 153 of the profile ring seal 118 of the valve body 117 toward the radiator interior. The lowering of the negative-pressure valve body 171 takes place counter to the prestressing force of the compression spring 167, so that in a manner not shown, a third flow connection between the radiator interior and the radiator exterior opens.

The invention claimed is:

1. A sealing cap for the opening of a container under pressure, comprising:

an inner cap part having a first and a second flow connection between the container interior and the container exterior, and a sealing seat; and a valve arrangement for opening and closing the flow connections, such that: when a first limit valve for the internal container pressure is exceeded, said first flow connection is opened and is then closed again when a second, higher limit valve for the internal container pressure is reached; and when a third limit valve for the internal container pressure, which is higher than both the first and the second limit valves of the internal container pressure, is exceeded, said second flow connection is opened, wherein:

said valve arrangement has: an axially displaceable single valve body; and a spring which presses said axially displaceable valve body in the direction of the container interior against said sealing seat;

said single valve body having a first, axially effective sealing face arrangement and a second, radially effective sealing face arrangement, said first axially effective sealing face arrangement having said first sealing seat, surrounding a connection opening to the container interior, and said second radially effective sealing face arrangement having a counterpart sealing face with a bypass around said first flow connection and a second radial counterpart sealing face with a safety relief opening of said second flow connection.

2. The sealing cap of claim 1, wherein:

said axially effective sealing face arrangement and said radially effective sealing face arrangement are united in a profiled sealing ring.

3. The sealing cap of claim 1, wherein:

said inner cap part includes a main element defining a bottom through which an opening passes; and said axial sealing seat is formed by an annular attachment which protrudes from said bottom of said main element.

4. The sealing cap of claim 1, wherein:

said inner cap part includes an inner wall on which said second, radially effective sealing face is formed; and said bypass is formed around said first flow connection in a first axial region of said wall by an annular insert.

5. The sealing cap of claim 4, wherein:

said bypass is embodied by a U-shaped throttling conduit on at least one circumferential point of said inner cap part.

6. The sealing cap of claim 5, wherein:

said annular insert has two radial conduits disposed to be axially disposed, which are formed by an axial conduit between the outer face of said annular insert and said inner face of said inner cap part.

7. The sealing cap of claim 1, wherein:

said bypass has two radial conduits; and said radially effective sealing face arrangement has two sealing face regions, whose axial spacing is less than the axial spacing of said two radial conduits of said bypass.

8. The sealing cap of claim 1, wherein:

said inner cap part further has a profiled sealing ring; and said two sealing face arrangements are formed by a circumferential clearance in said profiled sealing ring.

* * * * *

UNITED STATES PATENT AND TRADEMARK OFFICE

CERTIFICATE OF CORRECTION

PATENT NO. : 7,104,415 B2
APPLICATION NO. : 10/239843
DATED : September 12, 2006
INVENTOR(S) : Reutter It is certified that error appears in the above-identified patent and that said Letters Patent is hereby corrected as shown below:

Please make the following corrections in the claims:

Column 13, the word "valve" which appears in lines 24, 25, 28, and 29 should be corrected to read as the word: --value--

Column 13, the word "valves" which appears in line 31 should be corrected to read as the word: --values--

Signed and Sealed this

Seventh Day of August, 2007

JON W. DUDAS
*Director of the United States Patent and Trademark Office*